United States Patent [19]

Shaw

[11] Patent Number: 4,804,006

[45] Date of Patent: Feb. 14, 1989

[54] WASHING WATER DISPERSION ASSEMBLY FOR A DISHWASHER

[76] Inventor: John B. Shaw, 4425 Gateway Dr., Monroeville, Pa. 15146

[21] Appl. No.: 83,046

[22] Filed: Aug. 10, 1987

[51] Int. Cl.[4] ..... B08B 3/02

[52] U.S. Cl. ..... 134/177; 134/179

[58] Field of Search ..... 134/179, 177, 180

[56] References Cited

U.S. PATENT DOCUMENTS 3,807,636 4/1974 Fackler ..... 134/179 X 4,557,283 12/1985 Shaw ..... 134/179 X

*Primary Examiner*—Philip R. Coe

*Attorney, Agent, or Firm*—Clifford A. Poff; Thomas H. Murray

[57] ABSTRACT

A portable, countertop dishwasher having a washing media dispensing nozzle structure which includes radially-projecting, washing media-dispensing arms located in surrounding relationship with the axis of the nozzle structure and axially intermediate upper and lower nozzle structure pivot supports, the unitary dish rack including support structures for supporting articles to be washed within the radial sweep of the radially perfecting arms of the nozzle structure and being selectively removable from the dishwasher independently of the nozzle structure. The lower nozzle structure has dispensing nozzles for discharging washing media only vertically upward and the upper nozzles structure has dispensing nozzles for discharging washing media substantially only horizontally.

8 Claims, 2 Drawing Sheets

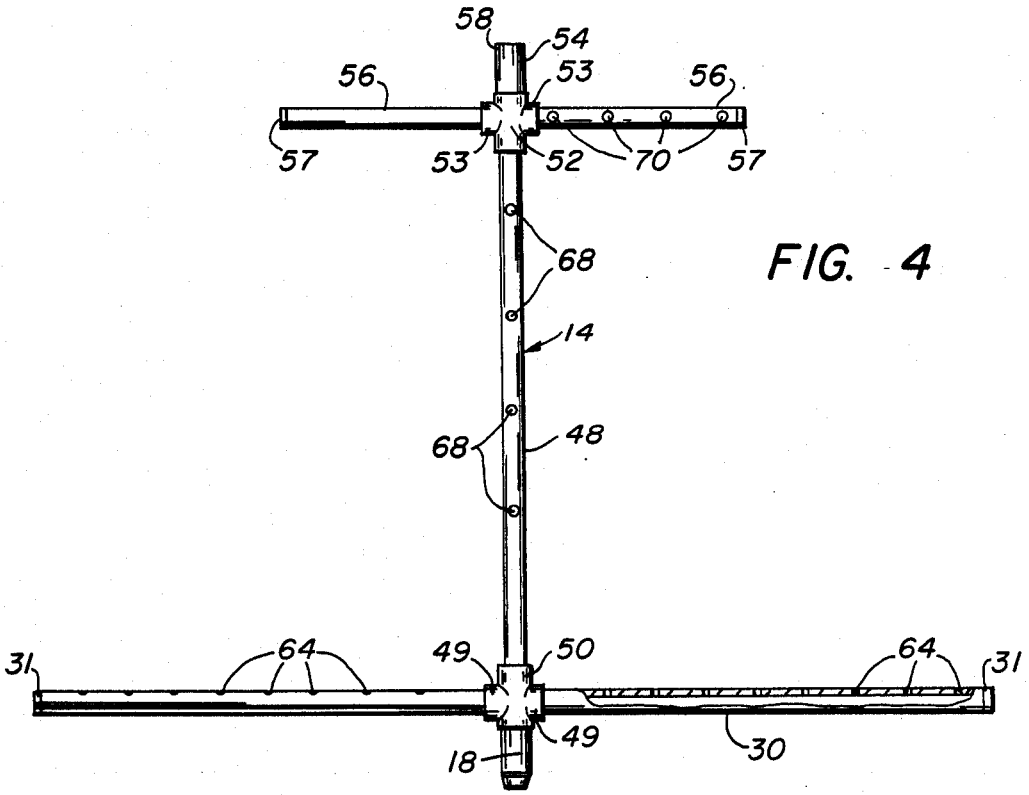
FIG. 4
FIG. 5
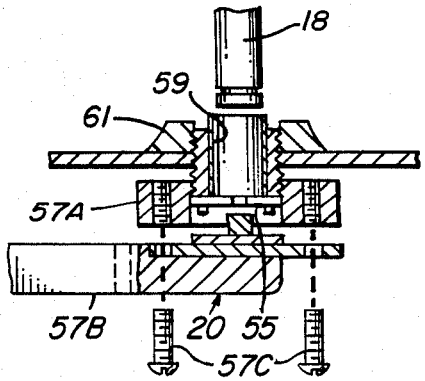
FIG. 1
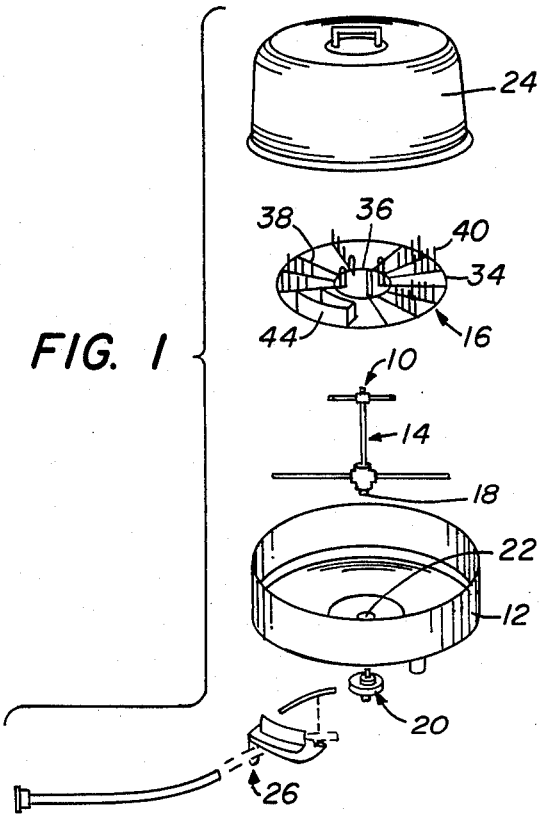

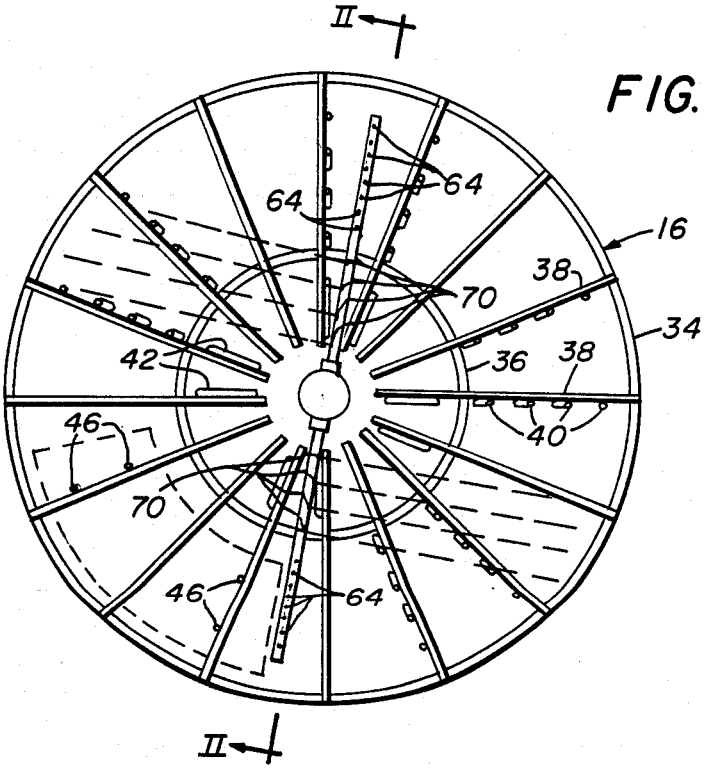
FIG. 3
FIG. 2
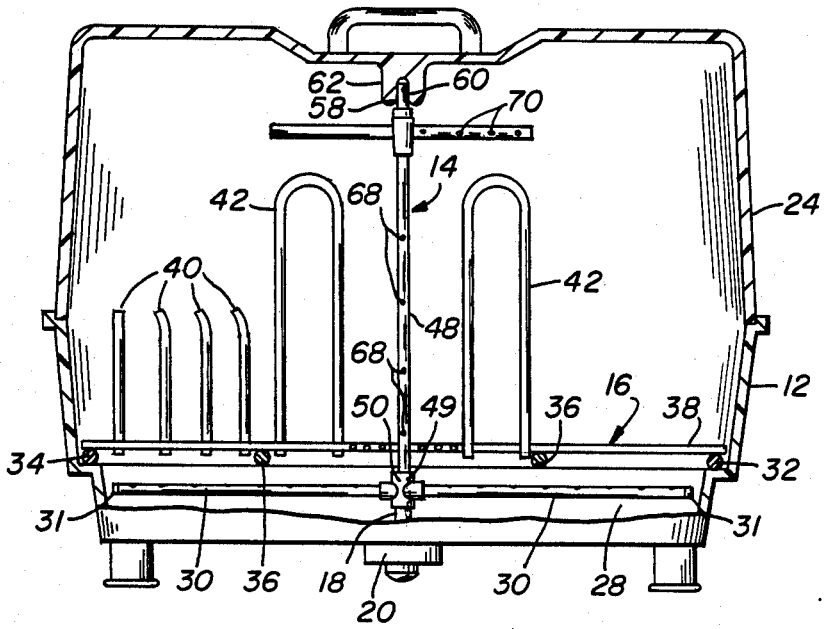

WASHING WATER DISPERSION ASSEMBLY FOR A DISHWASHER

BACKGROUND OF THE INVENTION

1. Field of the Invention

This invention relates to dishwashers and, more particularly, to dishwashers having an improved washing-water dispersion assembly therein.

2. Description of the Prior Art

It is known in the art of dishwashers to provide a water-powered countertop dishwasher wherein the dishes remain stationary and the washing media are supplied to a horizontallyrotatable hollow arm provided with spray nozzles or apertures, only some of which are oriented to project water from the arm onto the dishes and wherein other spray nozzles or spray apertures are directed so that the emission of water therefrom provides a turning moment which causes the arm to rotate.

Such dishwashers typically have been of lightweight and portable design and have been adapted to wash a relatively small quantity of tableware as the dish rack is usually of limited capacity. Prior art examples of such dishwashers include those disclosed in U.S. Pat. Nos. 4,557,283, 4,420,005, 4,135,532 and 3,773,060.

Such dishwashers have been of very limited size, for the sake of convenient portability, and this size limitation has had a impact upon cleaning capability because of interior space limitations which directly impact the availability of adequate space between the dishes for effective washing. The rotary nozzle system is provided to disperse a mixture of water and detergent and rinse water within the dishwasher. The size limitations of the dishwasher as well as typical water pressure limitations directly impact the size and design of the rotary nozzle system. Without unduly limiting the dish capacity of the dishwasher, practitioners have constantly sought to improve the rotary nozzle system to optimize the washing process while at the same time utilizing the water pressure to develop a force sufficient to rotate the nozzle system.

DESCRIPTION OF THE PRESENT INVENTION

The object of the present invention is to provide an improved washing media dispersion nozzle system.

More specifically, the present invention provides for an improved nozzle system having upper and lower horizontal nozzle arms. The nozzle arms are carried by an upstanding rotary spindle which is pivotally supported adjacent both of its axial ends for axial rotation to thereby rotate the arms horizontally. Liquid discharge orifices arranged in the horizontal arms to deliver liquid streams in the lower arm are essentially only vertically upward, and in the upper arms the liquid discharge orifices are arranged for delivering liquid streams essentially in a generally horizontal direction.

The nozzle system of this invention cooperates with the dish rack such that, although it is constructed with upper and lower nozzle arms to surround the nozzle system intermediate the rotationally supported ends of the nozzle system, the dish rack is nevertheless removable from the dish washer without disassembly of the nozzle system therefrom. The rotary support for the lower end of the nozzle system is constructed to fit in a socket having a snap ring retainer to engage with the nozzle structure. The upwardly directed sprays augment the operation of the retainer by the development of a downwardly directed reaction force on part of the nozzle structure in the socket.

These features and advantages of the invention will be more readily understood when the following detailed description is read in light of the accompanying drawings, in which:

FIG. 1 is an exploded perspective view of the dishwasher of the present invention;

FIG. 2 is a sectioned side elevation of the assembled dishwasher of FIG. 1;

FIG. 3 is a generally schematic plan view of the nozzle structure and rack of the invention;

FIG. 4 is a partially-sectioned, side elevation of the nozzle structure; and FIG. 5 is an enlarged sectional view of the rotary fitting and lower end section of the nozzle structure.

There is generally indicated at 10 in FIG. 1 a dishwasher constructed according to the preferred embodiment of the present invention. The dishwasher 10 comprises a molded plastic body member or drum 12 within which a nozzle structure 14 and a dish rack 16 are carried. The lower end 18 of nozzle structure 14 is rotatably mounted in a rotary fitting 20 which is secured to the bottom of drum 12 and projects thereinto through a centrally-located bottom opening 22 to receive the end 18 of nozzle structure 14.

A transparent, molded plastic cover 24 fits atop drum 12 to thereby enclose dish rack 16 and nozzle structure 14 within a closed space encompassed by the assembled cover 24 and drum 12. A suitable assembly of connections and conduits, generally indicated at 26, is provided to connect rotary fitting 20 to any suitable source of water and to provide a water and detergent mix for the washing process.

Referring to FIGS. 1, 2 and 4, the drum 12 includes a lower well portion 28. Dish rack 16 is supported above lower arm portion 30 upon an annular shoulder 32 formed within drum 12. Dish rack 16 preferably comprises a welded wire structure which may be plastic coated or otherwise adapted to protect articles carried thereby from scratching, includes coaxial outer and inner rings 34 and 36 respectively which are connected together by a plurality of circumferentially-spaced, radially-extending wire elements 38 welded thereto.

Selected ones of the radial elements 38 include a plurality of upstanding dish supports 40 welded thereto at radially-spaced locations intermediate inner and outer rings 34 and 36. Supports 40 preferably are angled radially outward adjacent their upper ends to provide suitable dish support. Some of the radial elements 38 include an upstanding tang 42 secured thereto preferably at a location radially inward of inner ring 36. Each tang 42 is generally of an inverted U-shaped configuration having the free ends of its legs welded to the respective radial elements 38.

Several circumferentially-adjacent ones of radial elements 38 which do not have dish supports 40 provide clearance for a silverware basket 44 (FIG. 1) which is retained in place by upstanding prongs 46 (FIG. 3) affixed to the respective radial elements 38 underlying basket 44. It is to be appreciated that the representation of dish rack 16 in FIG. 2 is simplified for purposes of illustrative clarity to show only certain elements thereof. The described dish rack elements are located in a suitable pattern such as depicted in FIG. 3, whereby the various articles to be carried by the dish rack 16 are suitably positioned for washing by media dispersed from nozzle structure 14.

Referring to FIGS. 2, 4 and 5, nozzle structure 14 according to the present invention includes an upstanding, tubular, rotary spindle portion 48, the lower end of which is connected to a molded tee 50. The lower end portion 18 of nozzle structure 14 is also connected to tee 50 in axial alignment with spindle portion 48. The tubular media dispersing arms 30 are connected to side branches 49 of tee 50 and project laterally therefrom beneath dish rack 16. The radially outer ends of arms 30 are capped with caps 31. Another molded tee 52 is connected to the upper end of spindle portion 48 and an upper end stub 54 is also connected to tee 52 and projects upwardly therefrom in axial alignment with spindle portion 48.

Tubular upper arms 56 are connected to side branches 53 of tee 52 so as to project laterally therefrom, preferably superimposed directly above the lower arms 30. The radially outer ends of arms 56 are capped with caps 57. A pivot member 58 extends upwardly from the top of stub end 54 and is rotatably received within a downwardly open recess 60 formed in a depending pivot member 62 located centrally of cover 24 to provide pivotal support for the upper end of nozzle structure 14.

The rotatable nozzle structure 14 includes a number of nozzles or orifices for dispersing washing media within the dishwasher. According to the present invention, each of lower arms 30 includes a plurality of nozzles 64 which direct washing media only vertically upward onto the articles carried by rack 16 and into glasses or cups which are inverted on tangs 42. The vertical discharge of washing media not only maximizes the use of the washing media for the intended washing purposes but also produces a downwardly directed reaction force on the nozzle structure. The downward reaction force offsets an upward force on the nozzle structure due to the pressure of the washing media in the internal flow spaces of the nozzle structure. Thus, it can be seen from FIG. 5 that a snap ring 55 retained within a rotary fitting 20 is more effective for the intended purpose of rotatably holding the nozzle assembly in a liquid sealed manner in a metal sleeve bearing 59. The rotary fitting 20 also includes upper and lower valve assemblies 57A and 57B respectively which are connected together by screws 57C. The arrangement of vertical discharge orifices in the lower arms 30 relieves the pivot member 58 of large friction forces so that the forces necessary to rotate the nozzle structure 14 can be reduced without detriment to the cleaning efficiency of the dishwasher.

Returning to the illustration of FIG. 5, a nut member 61 is threadedly engaged with threads on the outer surface of the upstanding tubular wall which is part of the upper valve assembly 57A. The sleeve bearing 59 is supported by the upstanding tubular wall. Spindle portion 48 includes a plurality of axially spaced nozzles 68 which disperse washing media radially outward onto the articles carried by the dish rack 16.

Each of the upper arms 56 includes a plurality of nozzles 70 which direct washing media substantially only horizontally outward toward side walls of cover 24. The streams of washing media emerging from nozzles 70 are formed to fall short of the walls of the cover and cascade downwardly on the articles in the dish rack. Importantly, according to the present invention, the emerging streams of washing media from nozzles 70 form the sole means for imparting rotary torque to the entire nozzle structure. In the past, as shown for example in my U.S. Pat. No. 4,557,283, the nozzles in the upper and lower arms were oriented at an angle to vertical, approximately 30 degrees, to provide force couples that impart a rotary impetus to rotate the nozzle structure. This arrangement reduced the cleaning action by the streams of liquid because the streams did not effectively penetrate the heights of dishware on the rack.

The above-described arrangement of nozzles provides an improved washing action for articles carried in the dish rack by upward jets of media from nozzles 70 and radial jets of media from nozzles 56. The upper arms 56 are positioned directly above lower arms 30 so that the nozzle structure 14 requires a minimum of space for shipment and handling.

For the embodiment described, it is to be noted that upper arms 56 are contained entirely within the diameter of inner ring 36 of dish rack 16. Furthermore, the minimum circumferential clearance between adjacent radial elements 38 where they extend radially inward of ring 36 is sufficient to allow arms 56 to pass therebetween. The dish rack 16 may be removed from the dishwasher without disassembly of nozzle structure 14, even though the dish rack is able, by virtue of tangs 42 and radial elements 38, to carry articles within the radial extent of upper nozzle arms 56, and even though the dish rack surrounds a structure which is pivotally supported at both ends in operation.

According to the description hereinabove, the present invention provides a novel and improved portable, water-pressure powered dishwasher. The above description represents the presently preferred embodiment of the invention. As various alternatives and modified embodiments have been contemplated, it is intended that the invention be construed broadly and limited only by the scope of the claims appended hereto.

I claim as my invention:

1. In a portable, water-pressure-powered dishwasher, the combination comprising:

a nozzle structure rotatably supported within the dishwasher for rotation about a substantially vertical axis, and a dish rack adapted to be supported within the dishwasher in surrounding relationship with said vertical axis intermediate the axial ends of said nozzle structure, said nozzle structure comprising an upstanding tubular spindle portion and tubular media-dispersing arm portions which extend radially outward from said vertical axis, said arm portions including a first pair of tubular arms extending radially in opposite directions from said spindle portion beneath said dish rack, said arm portions further including a second pair of tubular arms extending radially in opposite directions from said spindle portion above said dish rack, said second pair of arms including media-dispersing orifice means for dispersing washing media under pressure only horizontally outwardly and from a plurality of openings in the tubular side walls thereof at locations spaced along substantially the entire lengths of said second pair of arms, and said first pair of arms including media-dispersing orifice means for dispersing washing media under pressure only vertically upwardly and from a plurality of openings in the tubular top walls thereof at locations spaced along substantially the entire lengths of said first pair of arms, onto articles carried by the dish rack.

2. The combination as claimed in claim 1 wherein only the media-dispersing orifices in the arms above the dish rack are oriented such that the dispersion therefrom of washing media under pressure imparts a rotary impetus to said nozzle structure.

3. The combination as claimed in claim 1 further including retaining means for retaining said nozzle structure.

4. The combination as claimed in claim 1 further including a removable cover for the dishwasher which encloses said nozzle structure and said dish rack within the dishwasher and which includes pivot means to rotatably support the upper axial end of said nozzle structure when said cover is in place on the dishwasher.

5. In a portable, water-pressure-powered dishwasher, a washing-media dispensing nozzle structure supported for rotation about a substantially vertical axis, said nozzle structure comprising:

tubular media-dispersing first and second arm means extending radially outward from said spindle portion;

said first arm means including media-dispersing orifice means for dispersing washing media under pressure substantially only upwardly and from a plurality of openings at locations spaced along substantially the entire length of said first arm means onto articles in the dishwasher;

said second arm means including media-dispersing orifice means for dispersing washing media under pressure substantially only horizontally and from a plurality of openings at locations spaced along substantially the entire length of said second arm means;

said spindle portion including upper and lower pivot means adjacent the opposite ends thereof; and rotary bearing means carried by said dishwasher and engagable with said upper and lower pivot means for support of said nozzle structure within the dishwasher.

6. The nozzle structure of claim 5 wherein said tubular arms include upper and lower arms located respectively, adjacent said upper and lower pivot means.

7. The nozzle structure of claim 6 wherein said upper arms are superimposed above said lower arms.

8. The nozzle structure of claim 5 wherein one of said rotary bearing means is carried by a removable cover for the dishwasher which encloses said nozzle structure within the dishwasher such that said one rotary bearing means engages the upper axial end of said spindle portion to rotatably support said nozzle structure when the cover is in place on the dishwasher, and the other of said rotary bearing means is incorporated in a rotary fluid connection which rotably engages the lower axial end of said spindle portion.

* * * * *